United States Patent [19]

Sudani

[11] Patent Number: 4,490,834

[45] Date of Patent: Dec. 25, 1984

[54] X-RAY APPARATUS

[75] Inventor: Yasuo Sudani, Misato, Japan

[73] Assignee: Tokyo Emix Corporation, Japan

[21] Appl. No.: 404,695

[22] Filed: Aug. 3, 1982

[51] Int. Cl.[3] ..... H05G 1/30

[52] U.S. Cl. ..... 378/110; 378/101

[58] Field of Search ..... 378/109, 110

[56] References Cited

U.S. PATENT DOCUMENTS 4,126,784 11/1978 Soeder ..... 250/421

4,191,889 3/1980 Cowell ..... 378/109

*Primary Examiner*—Craig E. Church

*Attorney, Agent, or Firm*—Merchant, Gould, Smith, Edell, Welter & Schmidt

[57] ABSTRACT

An X-ray apparatus comprising a step-down transformer for stepping down a line voltage, a first timer for generating a pulse signal of the pulse width corresponding to a preheating period in response to a start signal, and a second timer for generating a pulse signal of the pulse width corresponding to an X-ray radiation period in response to the stoppage of the output of the pulse signal of the first timer. The stepped down line voltage is impressed on an X-ray generator during the period of time, i.e., the preheating period for generating the pulse signal of the first timer to preheat an X-ray tube. The line voltage is impressed on the X-ray generator during the period of time for generating a pulse signal from the second timer to supply a rated tube voltage and filament voltage to the X-ray tube. At this time the X-ray tube radiates an X-ray.

8 Claims, 3 Drawing Figures

X-RAY APPARATUS

BACKGROUND OF THE INVENTION

The present invention relates to an X-ray apparatus.

Conventional X-ray apparatus have simultaneous heating/exciting system and a preheating system. In the simultaneous heating/exciting system, a current is supplied to the filament of an X-ray tube when the X-ray switch is turned on. A high voltage, i.e., a tube voltage, is simultaneously impressed between the cathode and anode electrodes of the X-ray tube. In the preheating system, when the X-ray switch is turned on, the filament is first heated and a tube voltage applied between the cathode and anode electrodes after a predetermined period of time. With the simultaneous heating/exciting system, there is a delay of approx. 0.1 to 0.3 sec. from the time the X-ray switch is turned on to the time the filament reaches a predetermined temperature thereby causing X-ray radiation. Also, since the X-ray output level increases as the temperature of the filament rises, the X-ray output radiation level will vary until it reaches a preset X-ray output level.

With the preheating system, since the filament is preheated, when a tube voltage is impressed between the anode and the cathode, a predetermined level of radiation will be immediately released, thereby obtaining a sharp rise. However, this preheating system requires a transformer for heating the filament and a transformer for producing a tube voltage, which costs more than the simultaneous heating/exciting system and increases the size and weight of the apparatus. It is required that an X-ray generator of a dental X-ray apparatus in particular be compact and light in weight for the purposes it is used. Therefore, in the dental usage, one tank includes a high voltage transformer and X-ray tube, a winding for filament heating being located on an iron core of the transformer, and simultaneous heating-/exciting systems are employed. However, this simultaneous heating/exciting system produces an obtuse X-ray output as described above and energizes the filament at the time of X-ray radiation. Accordingly, the temperature of the filament will vary depending on the condition when heating is started, and the radiation time and the X-ray output level transition will vary every time the apparatus is started. When the X-ray apparatus is, for example, initially operated, the filament is at ambient temperature, and after stopping operation the temperature will correspond to the length of the cooling period. In this manner, the X-ray radiation time and the rising time will vary depending on the X-ray radiation conditions. Therefore, the simultaneous heating-exciting system has a short X-ray radiation period, particularly, when performing a short time X-ray radiation, causing error in the X-ray radiation amount due to this irregularity and causes irregular radiation. In other words, the simultaneous heating/exciting system does not radiate a constant amount even when the radiation period is short.

Further, the above-mentioned error in short X-ray radiation has a great affect on film sensitivity, on restriction of irregular radiation dosage and on increases in X-ray source output. Therefore, it is desired to improve the reproducibility of the amount of radiation of X-rays during short radiation periods. Conventional dental X-ray apparatus, in particular require small size and low cost as well as good reproducibility of X-ray radiation amount.

SUMMARY OF THE INVENTION

It is an object of the present invention to provide an X-ray apparatus which is capable of providing good reproducibility of the X-ray radiation amount.

According to an X-ray apparatus of the present invention, the output terminal of a line voltage regulator for regulating a line voltage is connected to a switching circuit. The output terminal of the switching circuit is connected to one input terminal of a changeover circuit through a step-down transformer, and is connected directly to the other input terminal of the changeover circuit. The output terminal of the changeover circuit is also connected to an X-ray generator. The switching circuit is turned on by a predetermined timer signal generated from the first timer in response to the X-ray radiation start signal. The changeover circuit serves to connect the step-down transformer to the X-ray generator in response to the timer signal. At this time, a voltage that has been stepped down by 50 to 80% of the line voltage is applied to the X-ray generator to preheat the X-ray tube. A second timer generates a timer signal, corresponding to the X-ray radiation period, in synchronization with the line frequency after a predetermined period of time after the timer signal of the first timer. The changeover circuit is operated to supply the line voltage from the switching circuit directly to the X-ray generator in response to the timer signal of the second timer. At this time, the X-ray generator produces an X-ray of predetermined amount for the radiation period.

DETAILED DESCRIPTION OF THE PREFERRED EMBODIMENTS

Figure 1:
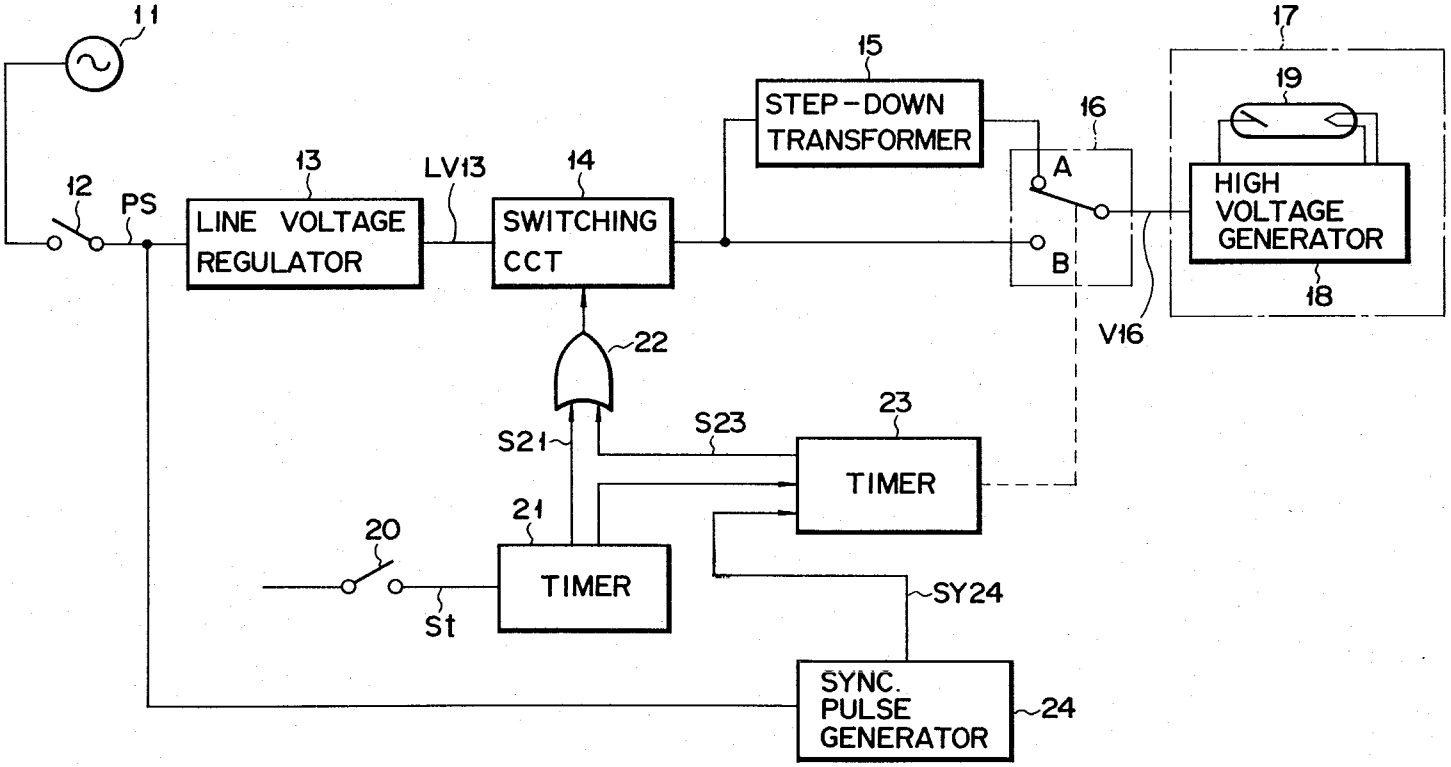
FIG. 1 is a block circuit diagram of an X-ray apparatus according to one embodiment of the present invention.

In FIG. 1, an AC power source 11 of commercial frequency (e.g., 50 Hz or 60 Hz) is connected to the input terminal of a line voltage regulator 13 through a power switch 12. The output terminal of the line voltage regulator is connected to a step-down transformer 15 through a switching circuit composed, for example, of an electromagnetic switch. The output terminal of the step-down tranformer is connected to one input terminal of a changeover switch circuit 16. The other input terminal of the changeover switch circuit 16 is connected directly to the switching circuit 14. The output terminal of the changeover switch circuit 16 is connected to the high voltage generator 18 of X-ray generator 17. The high voltage generator 18 comprises a transformer which outputs a tube voltage impressed between the anode and the cathode of an X-ray tube 19 and a voltage for supplying a filament current to the filament of the tube. An X-ray radiation start switch 20 is connected to the input terminal of a timer 21. This timer 21 is set at a predetermined time, e.g., the period of time required to preheat the X-ray tube 19, i.e., 0.1 to 0.3 sec. This period of time is set according to the characteristics and the preheating voltage of the X-ray tube. The output terminal of the timer 21 is connected to one input terminal of an OR gate 22 and to the input terminal of a timer 23. The output terminal of the timer 23 is connected to the other input terminal of the OR gate 22, and the synchronization terminal is connected to the output terminal of a sync pulse generator 24. The synchronization input terminal of the sync pulse generator 24 is connected to the input terminal of the line voltage regulator 13.

Figure 2:
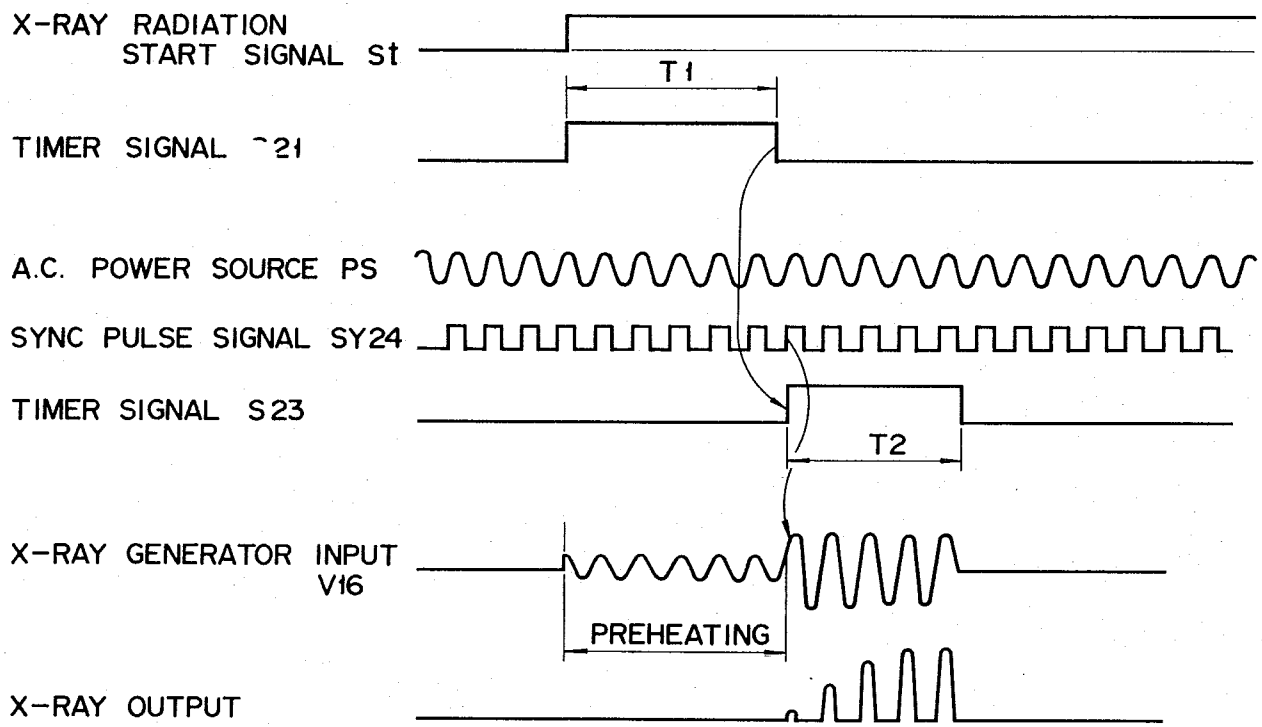
FIG. 2 is a time chart for explaining the operation of the X-ray apparatus in FIG. 1.

When the power switch 12 is turned on in the X-ray apparatus thus constructed, the output PS (FIG. 2) of the AC power source 11 is supplied to the line voltage regulator 13. The line voltage regulator 13 serves to regulate the voltage of the AC power source 11 to a predetermined line voltage. The output line voltage of the line voltage regulator 13 is supplied to the switching circuit 14. At this time the switching circuit 14 is OFF. When the X-ray radiation start switch 20 is turned on, an X-ray radiation start signal St (FIG. 2) is input to the timer 21. The timer 21 outputs a timer signal S23 of pulse width T1 (0.1 to 0.3 sec.) in response to the rise of the signal St. When the timer signal S23 is input through the OR gate 22 to the control terminal of the switching circuit 14, the switching circuit 14 becomes ON in response to the rise of the timer signal S23. At this time, the timer 23 serves to connect the changeover switch circuit 16 to a contact A. Accordingly, the line voltage LV13 stepped down, for example, by 50 to 80% by the step-down transformer 15 through the switch circuit, is input to the high voltage generator of the X-ray generator 17 through the switch circuit 16. The high voltage generator 18 serves to raise the supplied line voltage and impresses the voltage of 50 to 80% of the rated tube voltage and the filament voltage on the X-ray tube 19. At this time, the X-ray tube 19 becomes preheated. When preheating is performed, during the period of the pulse width T1 of the signal S21 so that the timer 21 is reset, the switching circuit 14 is turned off. At this time the timer 23 produces a time signal S23 of the pulse width T2 in synchronization with a reset signal of the timer 21 and the synchronization pulse SY24 initially presented after the timer 21 is reset. This timer signal S23 is supplied through an OR gate 22 to the switching circuit 14 to again turn on the switching circuit 14. In order to keep the switching circuit 14 on, a delay circuit is provided between the timer 21 and the OR gate 22. The timer 23 serves to switch the changeover switch circuit 16 to a contact B in response to the sync signal SY24. As a consequence, the line voltage LV13 is impressed to the X-ray generator 17 through the switching circuit 14. The high voltage generator 18 of the X-ray generator 17 impresses the rated tube voltage and the rated filament voltage to the X-ray tube 19. The X-ray tube 19 produces the X-ray shown in FIG. 2 according to the further temperature rise from the preheating temperature of the filament and the line frequency, i.e., commercial frequency. When the timer 23 is reset after a predetermined period of time, i.e., the period T2, the switching circuit 14 becomes OFF and the line voltage LV13 is interrupted, whereby X-ray radiation is stopped. At this time the changeover switch circuit 16 is reset to the contact A.

The above-mentioned operation is repeated every time the X-ray radiation start signal St is generated. In the embodiment described above, a voltage insufficient for radiating X-rays is applied to the X-ray tube to preheat it. After the completion of the preheating for the X-ray radiation, the tube voltage required for the X-ray radiation is impressed on the X-ray tube in synchronization with the commercial frequency. Since a voltage of a level enabling X-ray radiation is impressed on the X-ray tube at the predetermined phase of the line voltage waveform in this manner, an effective X-ray radiation can be carried out. As shown in the time chart in FIG. 2, the X-ray output varies at every positive half wave of the commercial waveform at the initial time of radiation, but since the filament temperature arrives at the predetermined temperature due to preheating, the tube voltage is impressed on the X-ray tube in the same voltage phase as the commercial voltage at the time of starting the X-ray radiation, after the preheating. Therefore, the voltage impressing conditions in the respective X-ray radiations are constantly equal, and the variation in the level of the X-ray output becomes constant. In this manner, according to the present invention, the reproducibility of the X-ray output can be improved, even for short time X-ray radiation.

Figure 3:
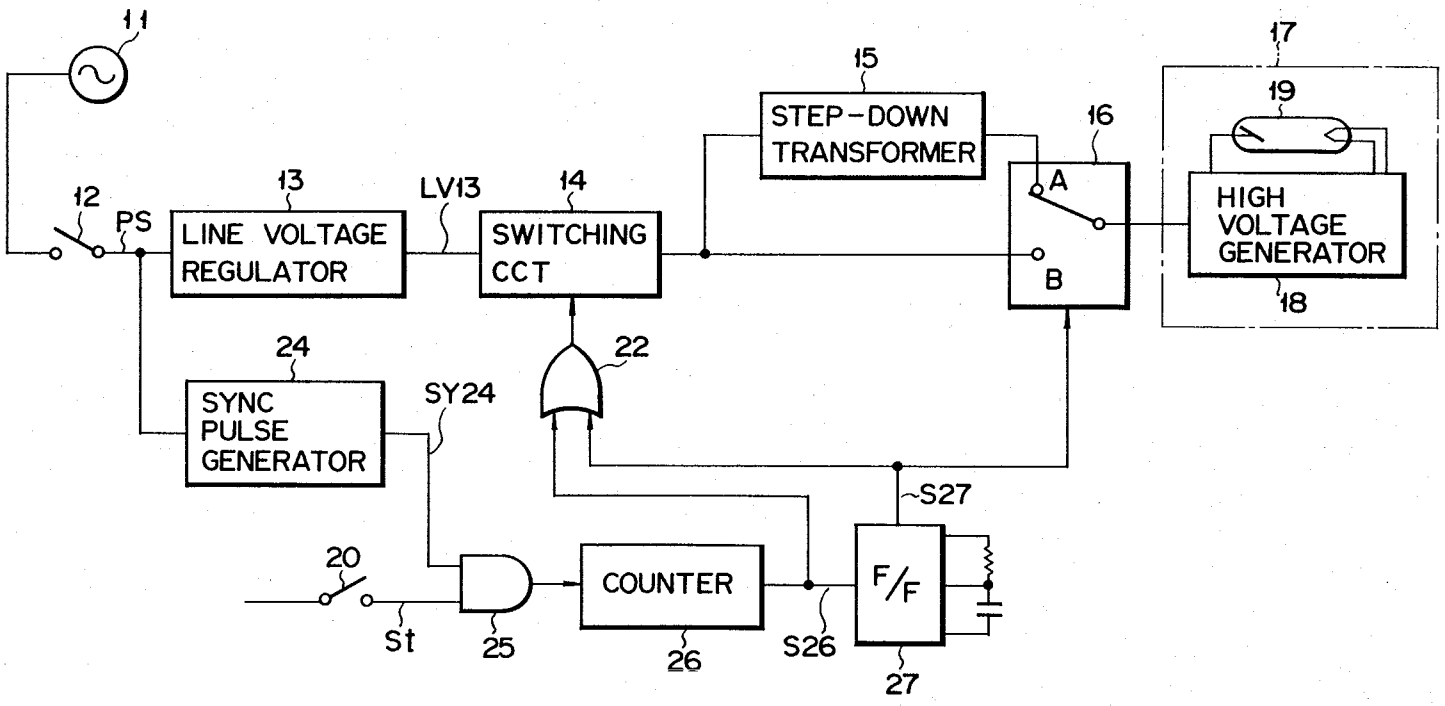
FIG. 3 is a block circuit diagram of the X-ray apparatus according to another embodiment of the present invention.

FIG. 3 shows a concrete embodiment of the timer circuit used in the X-ray apparatus of the invention. According to this embodiment, the output terminal of the sync pulse generator 24 is connected to one input terminal of the AND gate, and the other input terminal of the AND gate 25 is connected to the X-ray radiation start switch 20. The output terminal of the AND gate 25 is connected to the input terminal of the counter 26. The output terminal of the counter 26 is connected to one input terminal of the OR gate 22 and to the input terminal of a flip-flop 27. The output terminal of the flip-flop 27 is connected to the control terminal of the changeover switch circuit 16.

In the above-mentioned embodiment thus composed, when the signal St is input to the AND gate 25, the sync pulse signal SY24 is supplied to the counter 26. When the frequency of the power source 11 is 50 Hz, the sync pulse generator 24 generates a 50 Hz pulse signal SY24. When this pulse signal SY24 is supplied to the counter 26, the counter 26 is counted up at every 1/50 sec. When the preheating time is set to 0.1 sec., the counter generates a time signal S26 corresponding to the signal S21 in FIG. 2 during the period of time coinciding with 5 pulses. When the timer signal S26 is supplied to the switching circuit 14 through the OR gate 22, the switching circuit 14 becomes ON to pass the line voltage LV13. Since the switch circuit 16 is switched to the contact A by the output of the flip-flop 27 at this time, the voltage of 50 to 80% of the line voltage is impressed on the X-ray generator 17, and the X-ray tube 19 thus becomes preheated. When the output signal S26 of the counter 26 is stoped after 0.1 sec., the flip-flop 27 generates the pulse signal S27 of the time T2 corresponding to the signal S23 in response to the trailing edge of the signal S26. When the pulse signal S27 is supplied to the switching circuit 14 through the OR gate 22, the switching circuit 14 becomes ON state subsequent to the signal S26. Since the switch circuit 16 is switched to the contact B in response to the signal S27 at this time, the line voltage is supplied to the X-ray generator 17 without being stepped down through the switching circuit 14 and the contact B of the switch circuit 16. In this manner, the X-ray tube 19 radiates the X-ray. When the flip-flop 27 is reset after the time T2, the switching circuit 14 becomes OFF, so that the radiation of the X-ray is stopped. The X-ray radiation period is arbitrarily set by varying the time constant of the CR of the flip-flop 27. The preheating time T1 can be arbitrarily set by varying the preset value of the counter 26. The counter 26 may be composed of a counter or a preset counter which generates an output to the set value after reset. This counter 26 may be composed to produce a binary-decimal code, binary code, octal code or hexadecimal code. In this case the output of the digit stage corresponding to the required time duration may be inverted as required.

According to the X-ray apparatus embodying the present invention, there is provided an X-ray apparatus in which a voltage of the level not radiating X-rays, e.g., the voltage of 50 to 80% of the rated voltage is impressed on the X-ray generator for a predetermined period of time in response to the X-ray radiation start operation to preheat the X-ray tube and the rated voltage is applied to the X-ray generator after preheating. Since the X-ray tube is always in a predetermined preheating state at the time of radiation with such an X-ray apparatus, X-rays of a predetermined amount are output in every X-ray radiation operation in accordance with the predetermined output level change, thereby providing good reproducibility of the X-ray output.

What is claimed is:

1. An X-ray apparatus for driving an X-ray tube having specified tube voltage and filament voltage ratings and suitable for generating X-rays, comprising:

(a) line voltage output means for producing a line voltage of predetermined frequency;

(b) means for outputing a first timer signal of a first predetermined time in response to a start signal;

(c) means for producing a second timer signal of a second predetermined time in synchronization with the phase of the line voltage after the stoppage of the output of the first timer signal;

(d) switching means connected to said line voltage output means and closed by the first and second timer signals for passing the line voltage;

(e) means connected to said switching means for stepping down the line voltage passing through said switching means;

(f) changeover means connected to said switching means and said step-down means for changing from the step-down voltage to a line voltage; and (g) means connected to said changeover means and to said X-ray tube for supplying to said X-ray tube, tube voltage and filament voltage corresponding to the stepped-down line voltage as preheating voltages, and rated tube voltage and filament voltage corresponding to said line voltage as X-ray radiation voltages.

2. The X-ray apparatus according to claim 1, wherein said first timer signal output means generates a pulse signal having a pulse width coinciding with a preheating period.

3. The X-ray apparatus according to claim 2, wherein said preheating period is set from 0.1 to 0.3 sec.

4. The X-ray apparatus according to claim 1, 2 or 3, wherein said second timer signal output means generates a pulse signal having a pulse width coinciding with an X-ray radiation period.

5. The X-ray apparatus according to claim 1, wherein said first timer signal output means comprises a sync pulse generator for generating pulses synchronizing with the predetermined frequency of the line voltage, and a counter for counting the pulses of the sync pulse generator in response to the start signal to produce a signal having a pulse width equal to the first predetermined period of time.

6. The X-ray apparatus according to claim 5, wherein said second timer signal output means comprises a flip-flop for producing a signal having a pulse width equal to the second predetermined period of time in phase with the line voltage in response to the trailing edge of said first timer signal synchronizing with the frequency of the line voltage.

7. The X-ray apparatus according to claim 1, 2, 3 or 5, wherein the frequency of the line voltage is a commercial frequency.

8. The X-ray apparatus according to claim 1, 2, 3 or 5, wherein said step-down means is a step-down transformer for stepping down the line voltage by 50 to 80%.

* * * * *